United States Patent [19]

Seidler

[11] Patent Number: 5,031,647

[45] Date of Patent: Jul. 16, 1991

[54] COSMETIC SAMPLER APPLICATOR

[76] Inventor: David Seidler, 69-10 108th St., Forest Hills, N.Y. 11375

[21] Appl. No.: 431,101

[22] Filed: Nov. 3, 1989

[51] Int. Cl.[5] ..... A45D 40/26

[52] U.S. Cl. ..... 132/320; 132/317; 206/581; 206/823

[58] Field of Search ..... 132/317, 318, 320; 206/581, 823; 401/137, 138

[56] References Cited

U.S. PATENT DOCUMENTS

| | | | |
|---|---|---|---|
| 2,185,386 | 1/1940 | Valentine | 206/823 |
| 3,301,392 | 1/1967 | Regan, Jr. | 206/363 |
| 3,760,820 | 9/1973 | Seidler | 132/317 |
| 4,275,031 | 6/1981 | Fischer et al. | 422/57 |
| 4,611,611 | 9/1986 | Beal, Jr. | 132/320 |
| 4,648,506 | 3/1987 | Campbell | 206/216 |
| 4,739,778 | 4/1988 | Christie | 132/320 |
| 4,751,934 | 6/1988 | Moir et al. | 206/823 |
| 4,786,534 | 11/1988 | Aiken | 206/823 |
| 4,815,608 | 3/1989 | Silberberg | 206/823 |
| 4,876,136 | 10/1989 | Chang et al. | 132/320 |
| 4,915,234 | 4/1990 | Boeller | 132/318 |

*Primary Examiner*—John J. Wilson
*Assistant Examiner*—Frank A. LaViola
*Attorney, Agent, or Firm*—Blum Kaplan

[57] ABSTRACT

A sampler applicator for holding a predetermined amount of a spreadable-type product. The applicator includes a first elongated member having a first section for manual holding of the elongated member and a second section for holding the product. The second section includes a recessed portion defined by an upstanding wall which extends around the periphery thereof. The upstanding wall terminates in a relatively sharp edge with the sharp edge causing the product when in a melted state during manufacture to form a mound of the product extending above the upstanding wall.

27 Claims, 7 Drawing Sheets

FIG. 14A
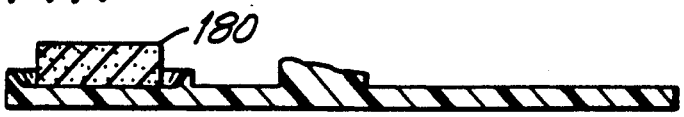
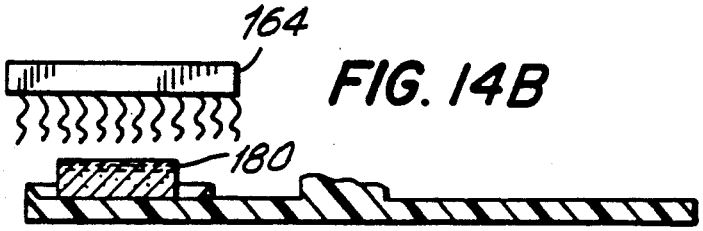
FIG. 14B
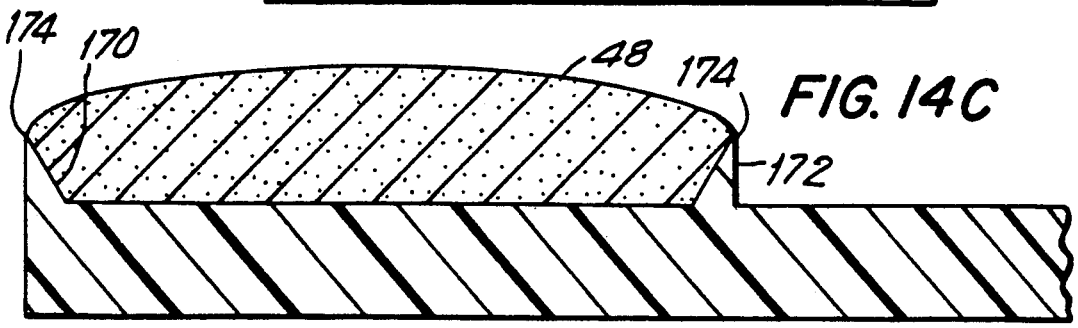
FIG. 14C
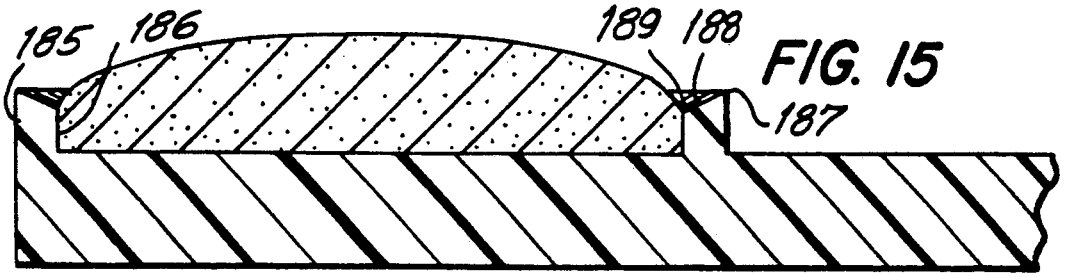
FIG. 15
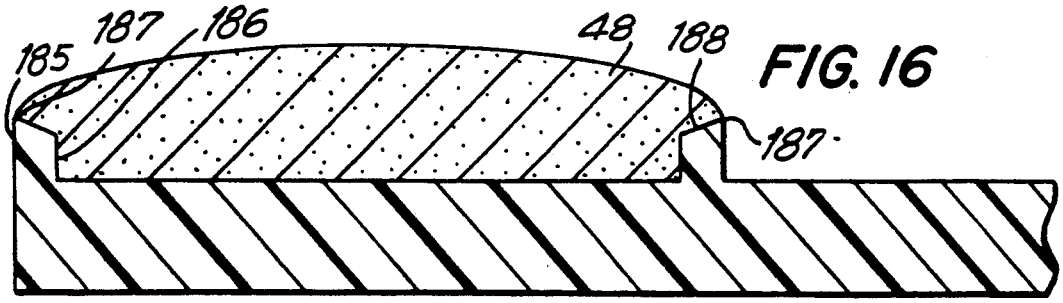
FIG. 16
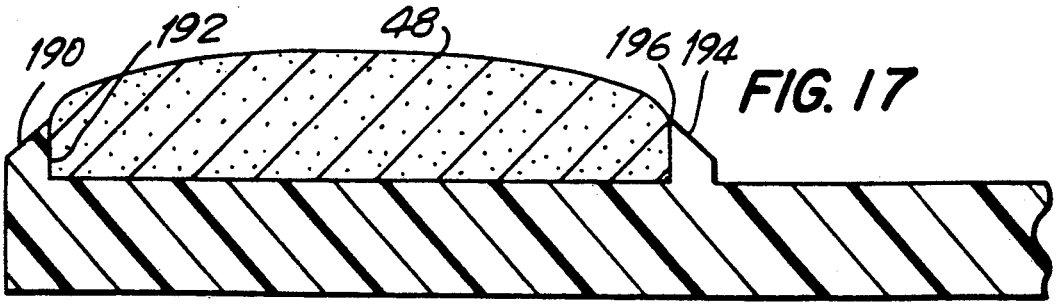
FIG. 17

400
28
28

410
48
430
404
402
450
406
426

30
30
430
440
404
426
406
402
48
412
410

430
440
404
450
406
402
410
416
48
412
418
420

COSMETIC SAMPLER APPLICATOR

BACKGROUND OF THE INVENTION

The present invention is directed generally to a cosmetic sampler applicator device and, in particular, to a cosmetic sampler device particularly suited for use in providing samples of a creamy or gelled cosmetic such as lipstick, eyeshadow or the like.

When shopping for cosmetic products such as lipstick, eyeshadow or the like, consumers generally desire to test such products on their own skin in order to determine whether the particular color or shade thereof is appropriate or desirable depending on the characteristics of the user. In the past, stores which sell such cosmetic products have provided actual retail samples on their cosmetic counters for users to try. Apart from the unsightly appearance such samples obtain after multiple uses, there is great concern of late about the spread of communicable diseases and the otherwise unsanitary conditions provided through multiple uses of the same product. With this concern in mind, various jurisdictions have even passed legislation prohibiting the reuse of cosmetic devices for sampling purposes and have required that individual samples be provided.

It is important that in providing individual samples of a cosmetic product that the sampling devices be inexpensive to manufacture while being adapted to retain a sufficient amount of the product to allow at least one complete application. It is also preferable when providing a lipstick sampler applicator which may contain more than a single application, that a replaceable cap or cover be provided to permit multiple uses. Accordingly, it is desired to provide a cosmetic sampler applicator which meets the criteria set forth above for hygienic sampling in a convenient and inexpensive package.

SUMMARY OF THE INVENTION

Generally speaking, in accordance with the present invention, a sampler applicator for holding a predetermined amount of a spreadable-type product for application by a user, is provided. The applicator includes a first elongated member having a first section for manual holding of the elongated member and a second section for holding the product. The second section includes a recessed portion forming a well defined by an upstanding wall extending around the periphery thereof. The upstanding wall terminates in a relatively sharp edge to prevent cosmetic product in the recess portion when in a flowable liquid state during manufacture from spilling over.

In a preferred embodiment, the applicator is formed from a thermoplastic material and includes a cover member which can be formed therewith through a living hinge arrangement which releaseably seals the recessed portion during storage. An opening in the cover allows filling of the well when the unit is closed and also permits direct viewing of the product stored in the recessed area or well. A clear label or other transparent window can be applied to cover the opening after filling.

Accordingly, it is an object of the present invention to provide an improved sampler applicator.

Another object of the present invention is to provide a cosmetic sampler applicator for holding a predetermined amount of a spreadable-type cosmetic product formed from a thermoplastic material.

A further object of the present invention is to provide a cosmetic sampler device which is easy and inexpensive to manufacture.

A still further object of the present invention is to provide a disposable cosmetic sampler applicator which includes a recessed well for holding a predetermined amount of a cosmetic product.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIGS. 14A and 14B depict a third method of filling the reservoir of the cosmetic sampler applicator of the present invention;

FIG. 14C is a partial sectional view showing a reservoir filled with cosmetic product according to the method depicted in FIGS. 14A and 14B;

FIGS. 15 through 17 depict alternative embodiments for the edge of the upstanding wall defining the reservoir in the applicator of the present invention;

DESCRIPTION OF THE PREFERRED EMBODIMENTS

Figures 1, 2, 3, 4, 5, 6:
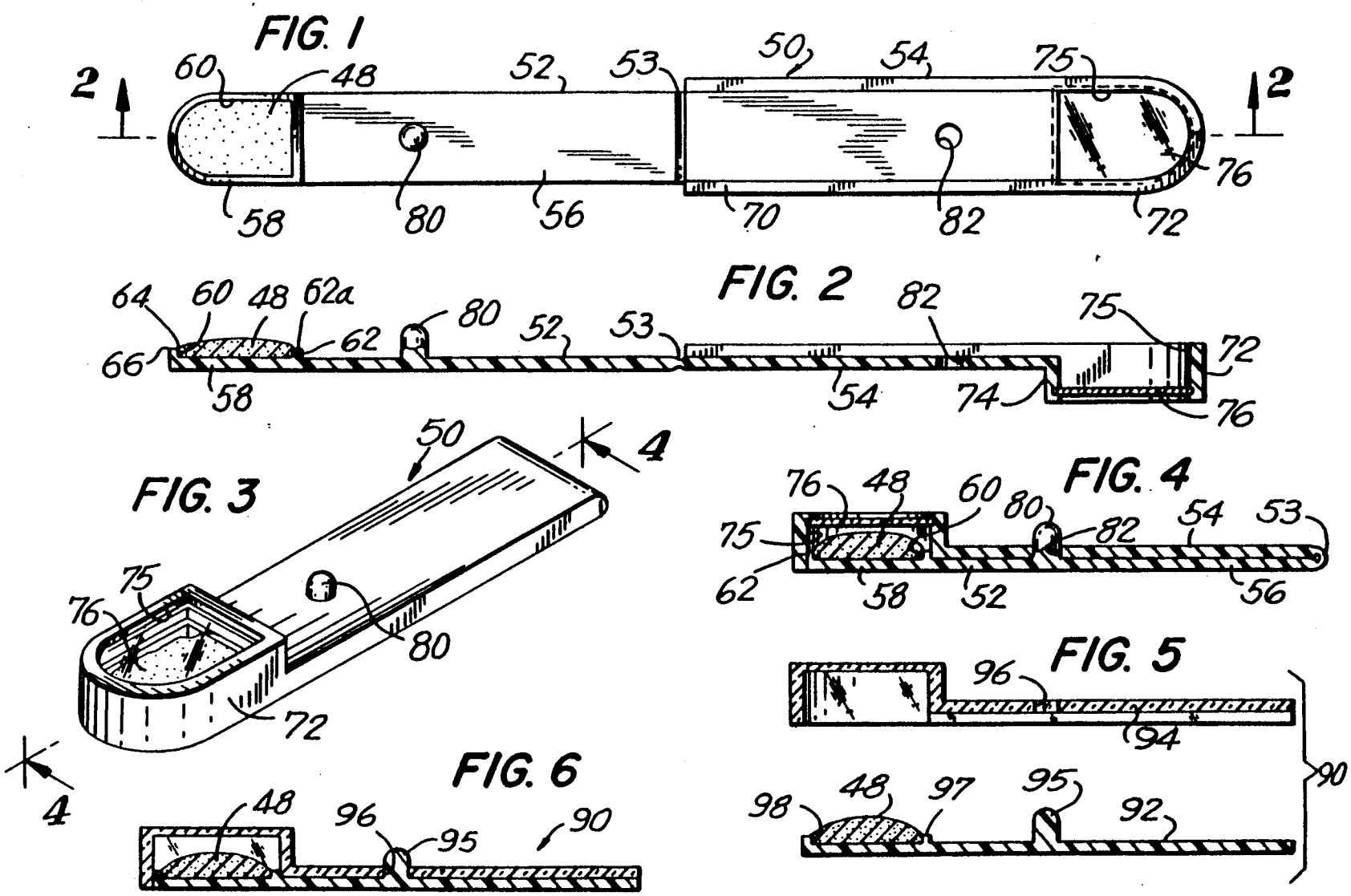
FIG. 1 is a top plan view of a cosmetic sampler applicator constructed in accordance with a first embodiment of the present invention.
FIG. 2 is a sectional view taken along line 2—2 of FIG. 1.
FIG. 3 is a perspective view of the cosmetic sampler applicator depicted in FIG. 1 shown with the cover closed.
FIG. 4 is a sectional view taken along line 4—4 of FIG. 3.
FIG. 5 is a exploded sectional view of a cosmetic sampler applicator constructed in accordance with an alternative embodiment of the present invention wherein the cover member comprises a separate member.
FIG. 6 is a sectional view similar to FIG. 5 but showing the cover in place on the unit.

Reference is first made to FIGS. 1 through 4 of the drawings which depict a cosmetic sampler applicator, generally indicated at 50, and constructed in accordance with a first embodiment of the present invention. Applicator 50 includes a first elongated member 52 and a second elongated member 54 hingedly coupled thereto through a living hinge 53. Applicator 50 is preferably formed from a thermoplastic material such as polypropylene.

First member 52 of applicator device 50 includes a first section 56 which defines a holding portion and a second section 58 defining a recessed portion or well 60. Recessed portion 60 includes an upstanding wall or retention ridge 62 which extends around the periphery thereof to form a well for holding a spreadable gelled or cream-type product such as a cosmetic product 48. Upstanding wall 62, as depicted, includes a top portion 62*a* which is flat and includes a inner relatively sharp edge 64 and an outer relatively sharp edge 66. (See FIG. 12B). As described below in detail, a mound of cosmetic product 48, such as a lipstick material, is formed in well 60 so as to extend above top surface 62*a* of wall 62 so that the product can be readily and easily applied during use.

Second member 54 includes a first portion 70 which also acts as a holding portion and a second cover portion 72 which forms the cover for well 60. When second member 54 is placed over first member 52 as depicted in FIGS. 3 and 4, it is seen that a wall 74 defining cover 72 surrounds recessed well 60. An opening 75 in cover 72 is provided to permit filling of the device when in the closed condition depicted in FIG. 3. A transparent window or label 76 may be provided over opening 75 in cover 72 to close off the opening and to permit viewing of the cosmetic product contained within well 60 after well 60 is filled.

First member 52 also includes a projection 80 and second member 54 includes a corresponding opening 82. When second member 54 is placed over first member 52 and cover 72 covers well 60, projection 80 will extend through opening 82 and act to hold the two components together in closed condition. By holding cover 72 and pressing button 80, the two members can be readily separated.

It is noted that living hinge 53 may be formed as a tearaway section to permit second member 54 to be detached from first member 52.

Reference is now made to FIGS. 5 and 6 which depict an alternative embodiment of the cosmetic sampler applicator of the present invention, generally indicated at 90. Applicator 90 includes a first member 92 and a separate independent member 94. One difference between the embodiment shown in FIGS. 5 and 6 and the embodiment shown in FIGS. 1 through 4 is that instead of including a living hinge 53, members 92 and 94 are formed as independent members. In addition, first member 94 is formed from a transparent plastic material such as a K-resin so that an independent window is unnecessary. Second member 94 snaps onto first member 92 by means of the button 95 and opening 96 arrangement. Once again, a raised wall 97 defines well 98 for holding cosmetic product 48 therein. Upstanding wall 97 includes sharp edges as described above for the reasons detailed below.

Figure 7:
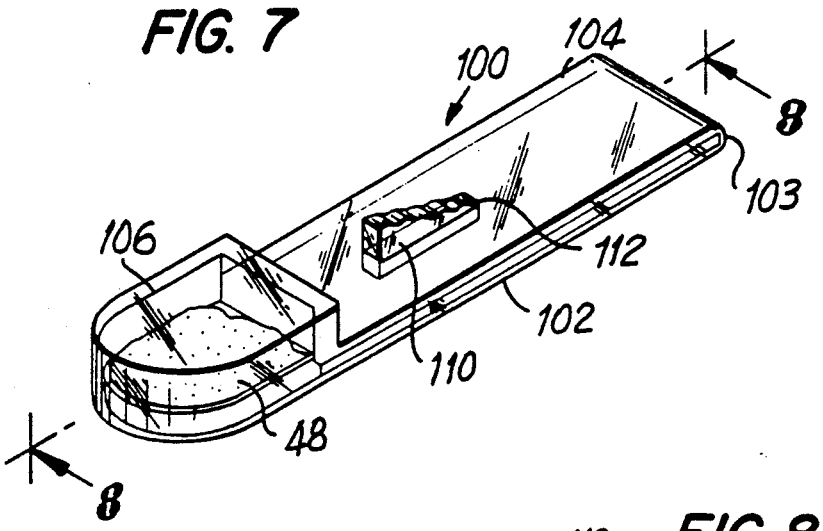
FIG. 7 is a perspective view of a cosmetic sampler applicator constructed in accordance with a third embodiment of the present invention.
Figure 8:
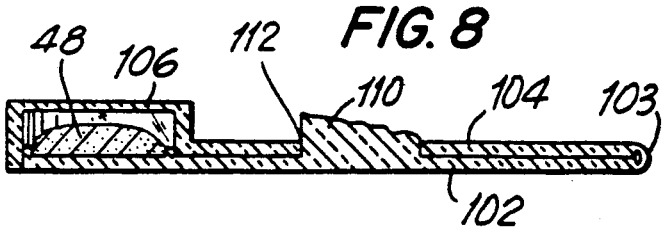
FIG. 8 is a sectional view taken along line 8—8 of FIG. 7.

The embodiment shown in FIGS. 7 and 8 is also similar to the first embodiment described above with reference to FIGS. 1 through 3, but a different button configuration is utilized. Sampler applicator 100 depicted in FIGS. 7 and 8 includes a first member 102 and a second member 104 hingedly coupled thereto through a living hinge 103. Sampler applicator 100 is formed of a transparent plastic material such as K-resin so that the entire unit is transparent. In particular, the portion of second member 104 which covers product 48, indicated at 106, is transparent and permits ready viewing of the cosmetic contained therein. In addition, instead of the circular button 80 depicted in FIGS. 1 through 3 above, a button 110 with an elongated inclined upper surface is provided. A corresponding opening 112 is provided in second member 108 for receiving button 110.

Figure 9:
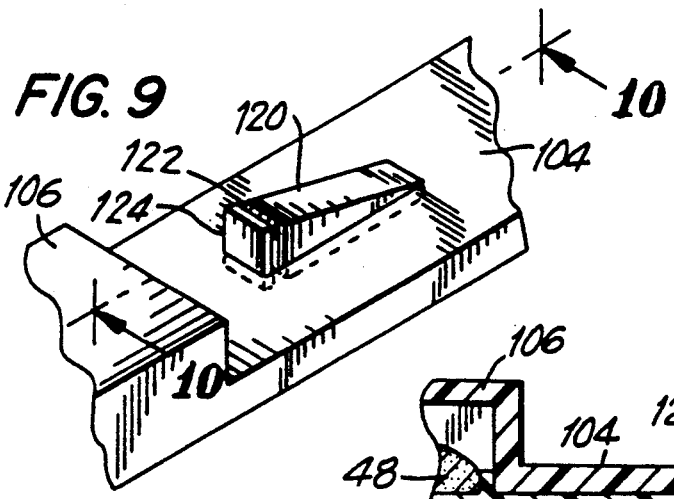
FIG. 9 is a partial perspective view showing an alternative button construction for the cosmetic sampler applicator of the present invention.
Figure 10:
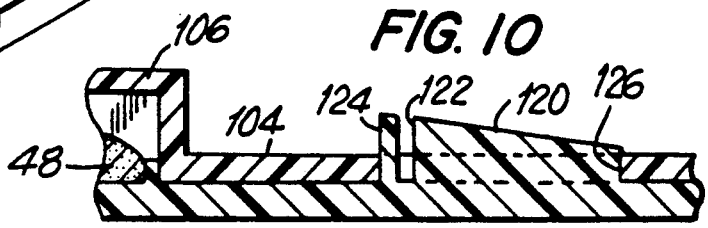
FIG. 10 is a sectional view taken along line 10—10 of FIG. 9.
Figure 11:
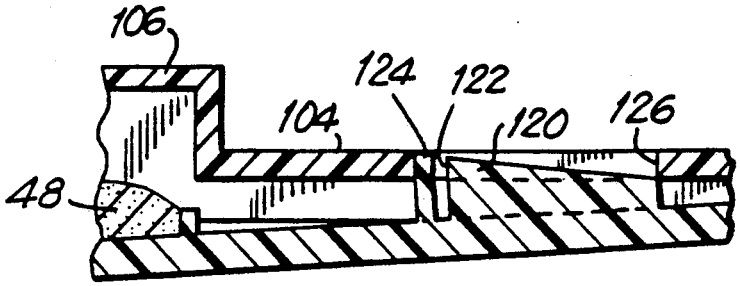
FIG. 11 is a sectional view similar to FIG. 10 but showing the cover in a semi-raised position.

FIGS. 9 through 11 depict an alternative embodiment of button 120 which includes a gap 122 to define a finger 124 which acts as a spring-type mechanism for pressing against opening 126 in cover member 104. This spring action facilitates both tight closing and ready opening of the device.

Figure 12A:
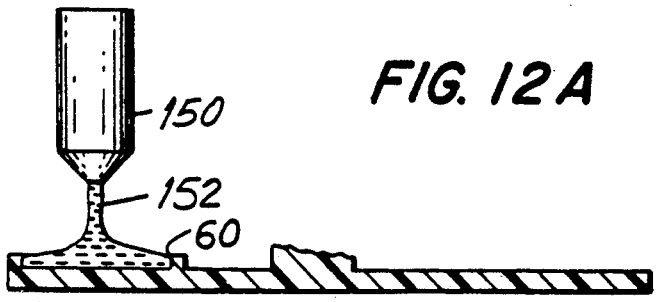
FIG. 12A is a partial sectional view showing one method of filling the cosmetic sampler applicator of the present invention.
Figure 12B:
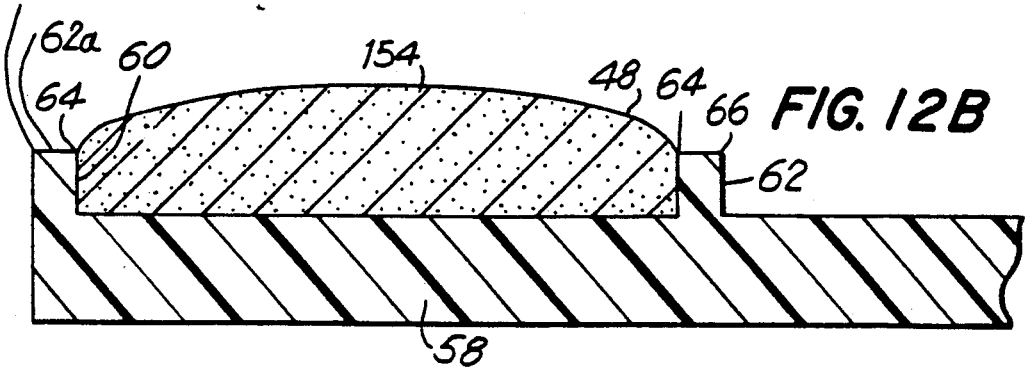
FIG. 12B is a partial section view showing a reservoir filled with cosmetic product according to the method depicted in FIG. 12A.

FIGS. 12A through 14C will noW be utilized for explaining various methods of filling the cosmetic sampler applicator device of the present invention with a spreadable cosmetic product such as lipstick. FIGS. 12A and 12B depict a hot filling method wherein the cosmetic product such as lipstick is melted into a liquid state before insertion. Hence, as seen in FIG. 12, the cosmetic product to be filled in reservoir 60 is supplied from a container 150 which contains the material in a molten state. The product 152 is poured into reservoir 60 and a mound 154 of product 48 is provided by the meniscus formed by reason of sharp edge 64. Hence when molten material 152 cools and hardens, the mound as depicted in FIG. 12B will be formed.

In conjunction with the surface tension of the liquid product, the sharp edges inhibit the flow of the product and result in the "freezing" and mounding of the product at the sharp edges.

Figure 13A:
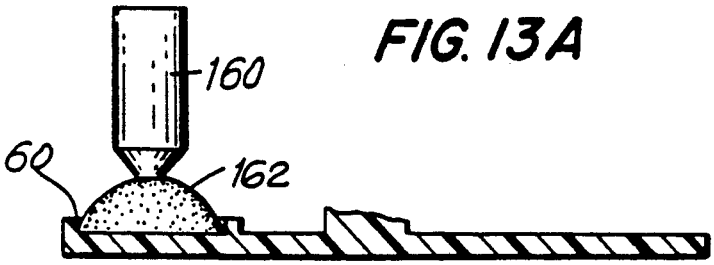
FIGS. 13A and 13B are partial sectional views showing an alternative method of filling the reservoir of the cosmetic sampler applicator of the present invention.
Figure 13B:
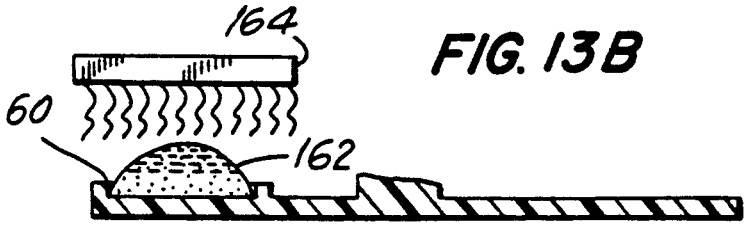
Figure 13C:
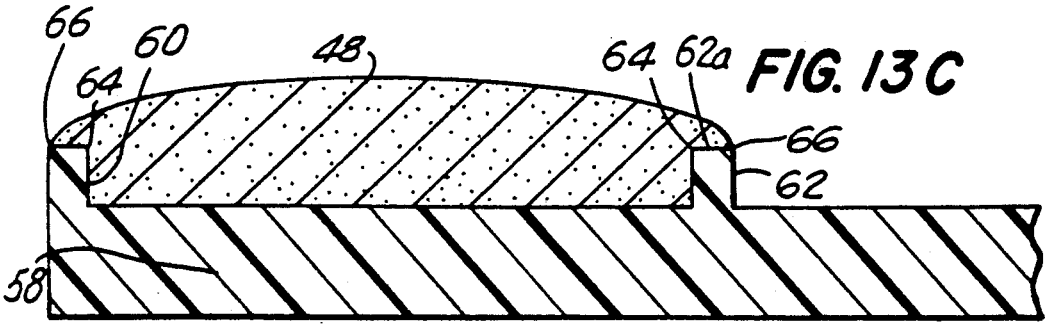
FIG. 13C is a partial sectional view showing a reservoir filled according to the method depicted in FIGS. 13A and 13B.
Figure 18:
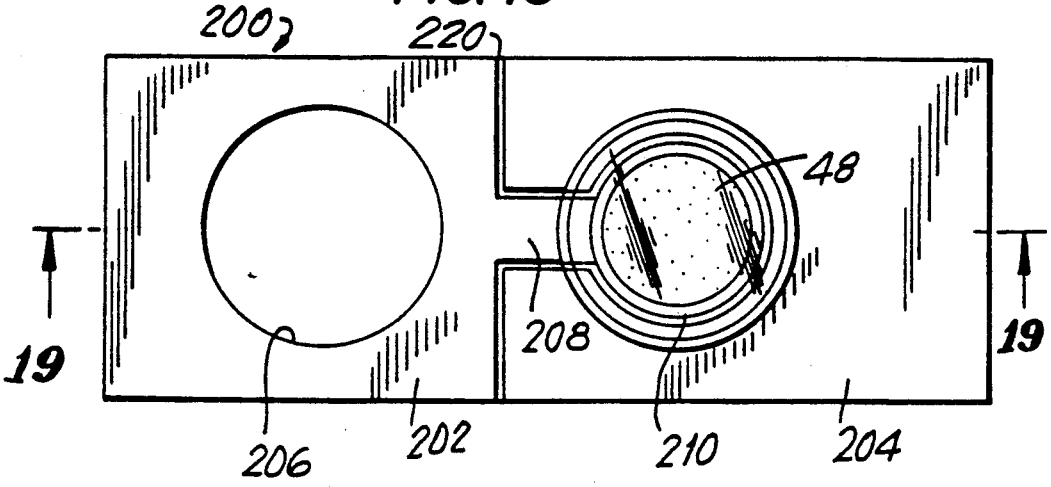
FIG. 18 is a top plan view of a cosmetic sampler applicator constructed in accordance with a fourth embodiment of the present invention.

FIGS. 13A through 13C depict an alternative method of filling reservoir 60. In particular, a container 160 supplies the product in cream form which is then used to fill reservoir 60 with cream material 162. A heat source 164 as depicted in FIG. 13B is then utilized to heat cream material 162 to melt same to fill reservoir 60 wherein product 162 will fill reservoir 60 with the mound shape depicted in FIG. 12B or the mound shape depicted in FIG. 13C. As depicted in FIG. 13C, the product 162 overflows upper wall 62*a* of upstanding wall 62 and is prevented from flowing thereover by means of outer sharp edge 66.

The third method for filling the reservoir is depicted in FIGS. 14A through 14C. It is noted that in FIGS. 14A through 14C reservoir 170 includes a differently shaped upstanding wall 172 in trianqular form which defines a sharp edge 174 at the top thereof. In FIG. 14A, a pellet 180 of the product is inserted in reservoir 170. As depicted in FIG. 14B, heat source 164 then heats the pellet to melt same to fill reservoir 170 as depicted in FIG. 14C. Sharp edge 174 prevents product 48 from flowing over the sides of the reservoir and acts to assist in forming the mound of material.

FIGS. 15 through 17 are presented to show that the upstanding wall defining the reservoir can take additional shapes. For example, as shown in FIG. 15, upstanding wall 185 defining reservoir 186 includes a sloped upper wall 188 having an inner sharp edge 189 and an outer sharp edge 187. In FIG. 15, inner sharp edge 189 prevents the product from flowing onto the inclined wall.

In FIG. 16, reservoir 186 is again defined by an upstanding wall 185 having an upper inclined surface 188, but product 48 now fills reservoir 186 and overflows upstanding wall 188 and is stopped by sharp edge 187.

Finally, FIG. 17 shows that upstanding wall 190 defining reservoir 192 can have an upper inclined wall 194 which slopes in a direction opposite to that depicted in FIGS. 15 and 16. In this case, sharp edge 196 prevents product 48 from flowing thereover and helps form the mound of material.

Reference is now made to FIGS. 18 through 21 which depict yet another embodiment of the present invention. Cosmetic sampler applicator, generally indicated at 200, includes a first member 202 and a second member 204. First member 202 includes an enlarged opening 206 and a projection arm 208 which supports a circular reservoir 210.

Reservoir 210 includes an upstanding wall 212 having a flat upper surface 214 and sharp edges 216 and 218.

Applicator device 200 is preferably formed from a thermoplastic material and is molded in the open condition depicted in FIG. 2. Arm 208 and reservoir 210 are then cut out of member 204. A living hinge 220 is formed between first member 202 and second member 204. A projecting wall 222 is formed as part of second member 204. A transparent cap 224 is sized to fit over projecting wall 222 to permit viewing of the cosmetic product 48 contained therein.

Figure 19:
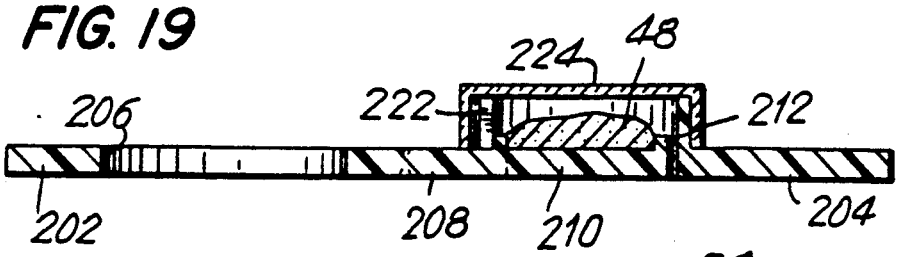
FIG. 19 is a sectional view taken along line 19—19 of FIG. 18.
Figure 20:
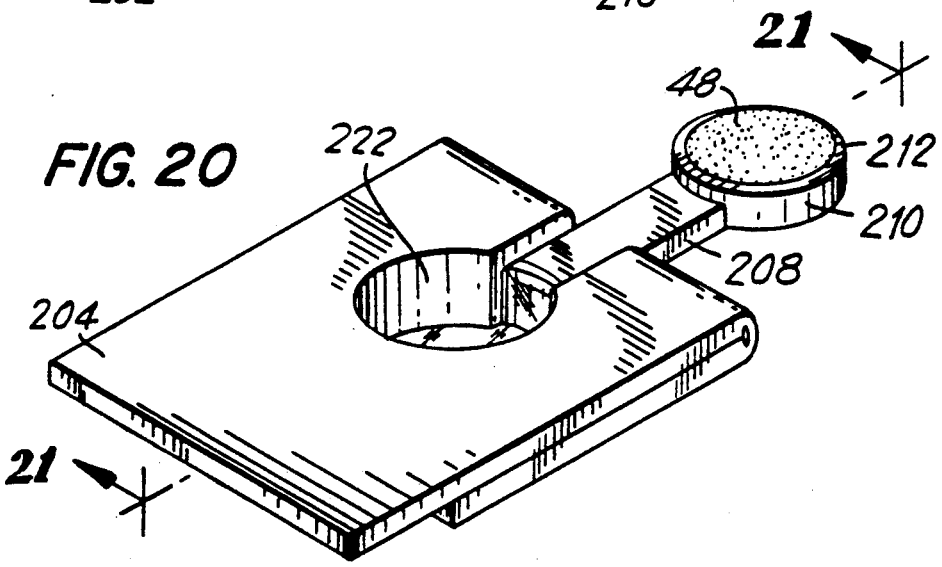
FIG. 20 is a perspective view of the cosmetic sampler applicator depicted in FIG. 18 with the cover shown moved to an open position.
Figure 21:
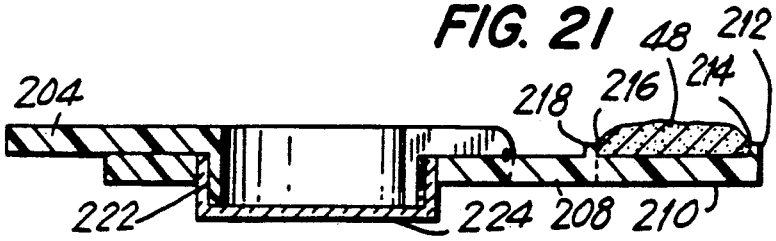
FIG. 21 is a sectional view taken along line 21—21 of FIG. 20.
Figure 22:
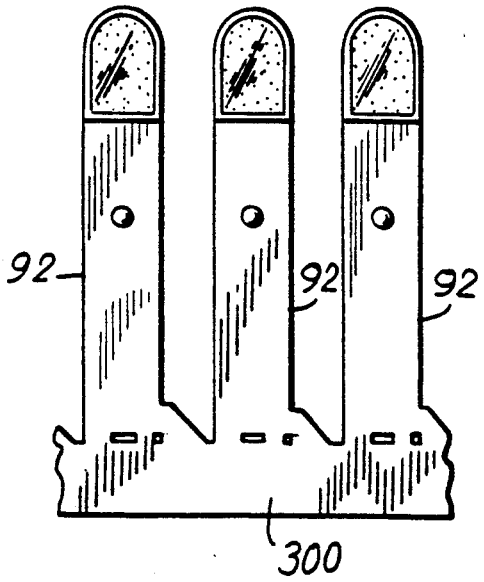
FIG. 22 is an elevational view showing a series of coupled cosmetic sampler applicators constructed in accordance with the present invention.
Figure 23:
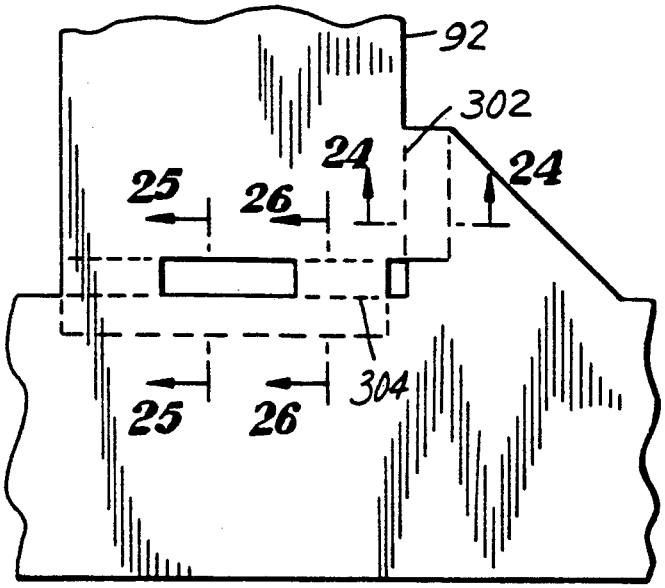
FIG. 23 is partial enlarged elevational view of the device depicted in FIG. 22.
Figure 24:
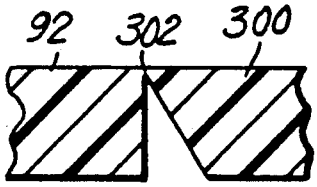
FIG. 24 is an enlarged sectional view taken along line 24—24 of FIG. 23.
Figure 25:
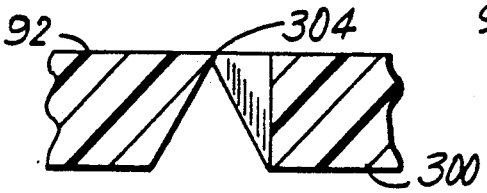
FIG. 25 is an enlarged sectional view taken along line 25—25 of FIG. 23.
Figure 26:
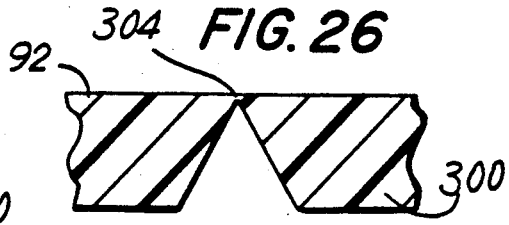
FIG. 26 is an enlarged sectional view taken along line 26—26 of FIG. 23.
Figures 27, 28, 29, 30:
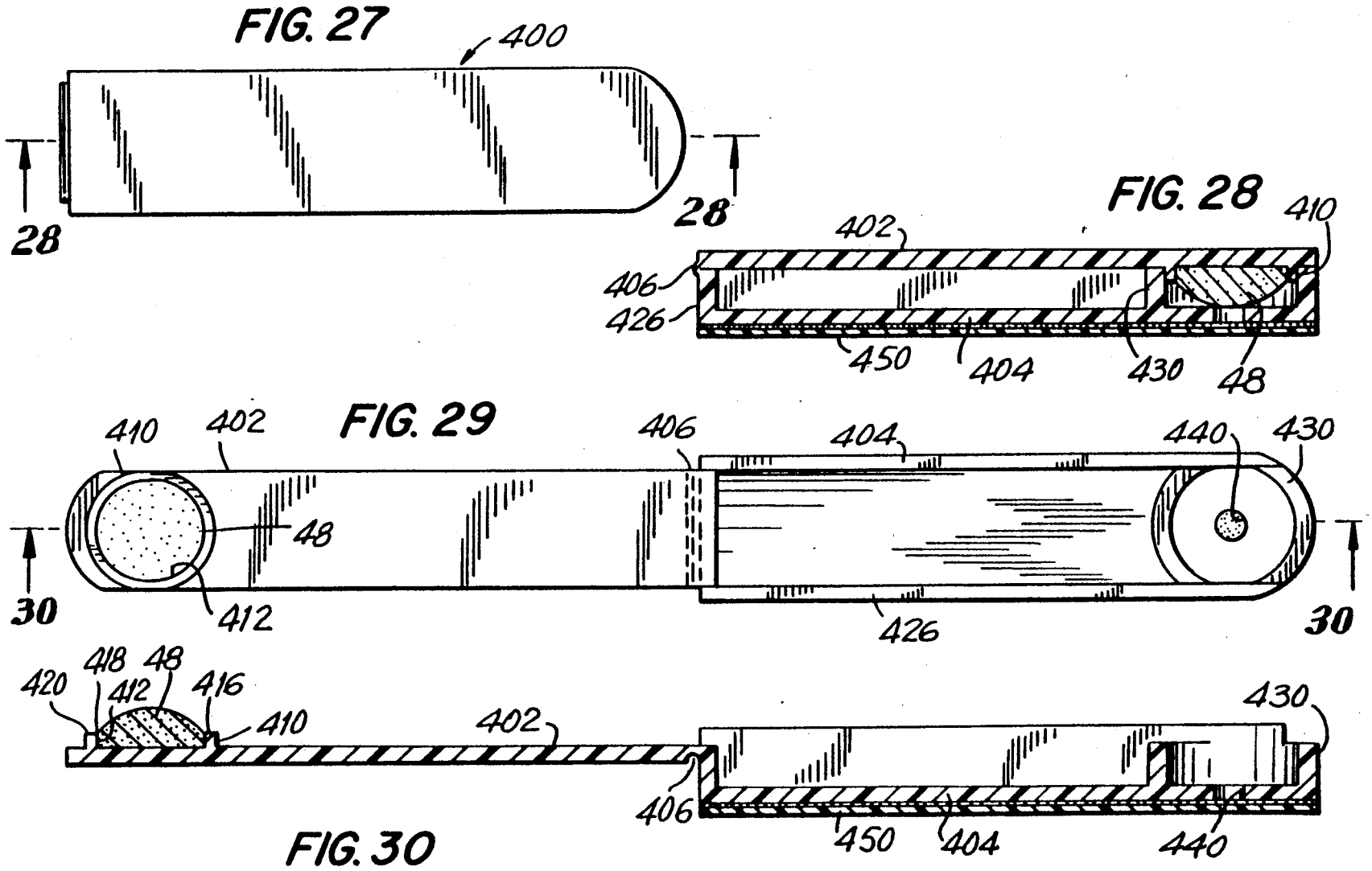
FIG. 27 is a top plan view of a cosmetic sampler applicator constructed in accordance with a fifth embodiment of the present invention.
FIG. 28 is a sectional view taken along line 28—28 of FIG. 27.
FIG. 29 is a top plan view of the cosmetic sampler applicator depicted in FIG. 27 shown with the cover open.
FIG. 30 is a sectional view taken along line 30—30 of FIG. 29.

When use is desired, member 204 is rotated in a counterclockwise direction from that depicted in FIG. 19 so that cap 224 is received in opening 206 which is sized to receive same. Reservoir 210 is then exposed for use. Due to the mound of product 48 contained in the reservoir the product can be readily applied.

FIGS. 22 through 26 depict a multiple component construction whereby a plurality of applicators 92 without covers along a strip of plastic 300 are provided. Tear away lines 303 and 304 are provided as depicted in FIGS. 23 through 26 to permit applicators 92 to be removed from panel 300 in tearaway fashion.

FIGS. 27 through 30 depict a final embodiment of the present invention. Applicator 400 depicted in these figures includes a first member 402 and a second member 404 pivotally coupled thereto through a living hinge 406. First member 402 includes a raised wall 410 defining a reservoir 412. Upstanding wall 410 includes a flat top surface 416 having sharp edges 418 and 420 to prevent product from spilling over and to form a mound of product as described above in detail.

Second member 404 includes a side wall 426 therearound adapted to snap over first member 402 to releaseably hold same therein. A circular wall 430 is formed at the end of second member 404 and is adapted to snap over and close off reservoir 412. An opening 440 is provided in second member 426 within circular area 430 to permit viewing of the product contained within reservoir 412. An adhesive label 450 can be placed on the underside of second member 404 which can contain a clear area for viewing through opening 440.

The present invention provides a neat and inexpensive package for holding a spreadable-type cosmetic product in cream or gel form such as lipstick or eyeshadow. The applicator can also be use for other spreadable products such as certain medicinal products. The disposable applicator is easily filled, adapted both for single and multiple use applications and permits the user to view the product contained in the applicator without opening thereof being required.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A sampler applicator for holding a predetermined amount of a spreadable-type product which permits direct application of said product comprising a first elongated member having a first section for manual holding of said elongated member and a second section for holding said product, said second section having a recessed portion defined by an upstanding wall extending around the periphery thereof, said upstanding wall terminating in a relatively sharp edge, said relatively sharp edge causing said product when in a melted state during manufacture to form a mound of said product extending above said upstanding wall, and a mound of said product supported in said recessed portion of said second section and extending above said upstanding wall.

2. The sampler applicator as claimed in claim 1, wherein said upstanding wall includes a flat upper surface.

3. The sampler applicator as claimed in claim 2, wherein said flat upper surface includes an inner side and an outer side and defines said relatively sharp edge on said inner side and a second relatively sharp edge on said outer side.

4. The sampler applicator as claimed in claim 1, wherein said upstanding wall includes an inclined upper surface.

5. The sampler applicator as claimed in claim 1, further comprising cover means for releaseably covering said second section of said first elongated member.

6. The sampler applicator as claimed in claim 5, wherein said cover means is hingedly coupled to said first section of said first elongated member.

7. The sampler applicator as claimed in claim 5, further comprising fastening means for releaseably coupling said cover means to said first elongated member.

8. The sampler applicator as claimed in claim 7, wherein said fastening means includes a projection on said first elongated means and a corresponding shaped opening on said cover means.

9. The sampler applicator as claimed in claim 8, wherein said projection is an inclined button.

10. The sampler applicator as claimed in claim 9, wherein said inclined button includes a gap defining a finger which is received in said opening.

11. The sampler applicator as claimed in claim 8, wherein said projection is a circular button.

12. The sampler applicator as claimed in claim 5, wherein said cover means includes an opening to permit filling of said recessed portion when said cover means is in place on said first elongated member.

13. The sampler applicator as claimed in claim 12, wherein said cover means includes a transparent window over said opening in alignment with said second section of said first elongated member.

14. The sampler applicator as claimed in claim 1, further comprising a second elongated member hingedly coupled to said first section of said first elongated member and fastening means for releaseably fastening said first and second elongated members together.

15. The sampler applicator as claimed in claim 14, wherein said fastening means includes sidewalls on said second member adapted to releaseably receive and hold said first member.

16. The sampler applicator as claimed in claim 15, wherein said second member includes an opening in alignment with said second section of said first member.

17. The sample applicator as claimed in claim 16, further comprising a peel-off label covering said opening.

18. The sampler applicator as claimed in claim 14, wherein said second elongated member includes a cover section which covers said second section of said first elongated member when said second elongated member is fastened to said first elongated member.

19. The sampler applicator as claimed in claim 18, wherein said first and second elongated members are molded integrally from a thermoplastic material with a living hinge hingedly coupling said members together.

20. The sampler applicator as claimed in claim 1, wherein said first elongated member is molded from a thermoplastic material.

21. The sampler applicator as claimed in claim 20, wherein said thermoplastic material is polypropylene.

22. The sampler applicator as claimed in claim 20, wherein said thermoplastic material is K-resin.

23. The sampler applicator as claimed in claim 20, wherein said first elongated member is formed together with a plurality of said members releaseably joined to a thermoplastic strip.

24. A sampler applicator for holding a predetermined amount of a spreadable-type product which permits direct application of said product comprising a first member and a second member formed integrally from a thermoplastic material and hingedly joined together through a living hinge, said second member having a region cut-out to form a reservoir having an arm coupled to said first member, said reservoir including an upstanding wall having a sharp edge and adapted to hold a mound of said product extending above said wall, and a mound of said product supported in said reservoir of said second member and extending above said upstanding wall, said second member being foldable along said living hinge to expose said reservoir for use.

25. The sampler applicator as claimed in claim 24, wherein said second member includes a cover for covering said reservoir, said first member including an opening for receiving said cover when said second member is folded onto said first member.

26. A sampler applicator for holding a predetermined amount of a spreadable-type product which permits direct application of said product comprising a first elongated member having a first section for manual holding of said elongated member and a second section for holding said product, said second section having a recessed portion defined by an upstanding wall extending around the periphery thereof, said upstanding wall terminating in a relatively sharp edge, said relatively sharp edge causing said product when in a melted state during manufacture to form a mound of said product extending above said upstanding wall, a mound of said product supported in said recessed portion of said second section and extending above said upstanding wall, and cover means for releaseably covering said recessed portion, said cover means including an opening in alignment with said recessed portion.

27. The sampler applicator as claimed in claim 26, wherein said cover means includes a transparent window covering said opening.

* * * * *